US008226384B2

(12) United States Patent
Finkenbinder et al.

(10) Patent No.: US 8,226,384 B2
(45) Date of Patent: Jul. 24, 2012

(54) LABYRINTH SEAL FOR A MOTOR-FAN UNIT

(75) Inventors: David B. Finkenbinder, Ravenna, OH (US); Robert A. Ciccarelli, Kent, OH (US)

(73) Assignee: Ametek, Inc., Paoli, PA (US)

( * ) Notice: Subject to any disclaimer, the term of this patent is extended or adjusted under 35 U.S.C. 154(b) by 911 days.

(21) Appl. No.: 12/151,388

(22) Filed: May 6, 2008

(65) Prior Publication Data

US 2009/0280004 A1 Nov. 12, 2009

(51) Int. Cl.
*F04D 29/08* (2006.01)
*F04D 25/06* (2006.01)

(52) U.S. Cl. ..... 417/423.14; 277/303; 277/412; 415/174.5

(58) Field of Classification Search ..... 417/366, 417/423.9, 423.12, 423.15, 423.2; 277/423, 277/425, 427, 309, 349, 412, 414, 415, 421, 277/551; 415/174.5; 416/174
See application file for complete search history.

(56) References Cited

U.S. PATENT DOCUMENTS 2,126,383 A * 8/1938 Grothe ..... 422/124
2,668,068 A * 2/1954 Bredemeier ..... 277/390
2,907,595 A * 10/1959 Benson et al. ..... 277/303
2,936,715 A * 5/1960 Southam et al. ..... 415/115
3,028,181 A * 4/1962 Thompson et al. ..... 277/424
3,755,870 A * 9/1973 Young et al. ..... 29/898.11
4,088,424 A 5/1978 Hyatt et al. ..... 417/368
4,105,378 A * 8/1978 Hodge ..... 418/195
4,226,575 A 10/1980 Hyatt et al. ..... 417/423
4,527,960 A * 7/1985 DeSisto ..... 417/368
4,698,534 A * 10/1987 Smith et al. ..... 310/89
5,482,378 A 1/1996 Vona, Jr. et al. ..... 384/134
5,720,486 A * 2/1998 Hutchings et al. ..... 277/413
5,927,720 A * 7/1999 Zinsmeyer et al. ..... 277/303
6,257,587 B1 * 7/2001 Toth et al. ..... 277/309
6,472,786 B1 10/2002 McCauley et al. ..... 310/90
6,966,746 B2 * 11/2005 Cardenas et al. ..... 415/1
2004/0091356 A1 * 5/2004 Gerlach et al. ..... 416/174
2006/0279147 A1 * 12/2006 Pardee ..... 310/77

* cited by examiner

*Primary Examiner* — Devon C Kramer
*Assistant Examiner* — Nathan Zollinger
(74) *Attorney, Agent, or Firm* — Renner Kenner Greive Bobak Taylor & Weber

(57) ABSTRACT

A labyrinth seal for a bypass discharge-type motor-fan unit includes a motor unit from which extends a rotating shaft that passes through an aperture in an end plate to drive a fan unit. Disposed within the aperture is a labyrinth seal configured to prevent liquid entrained in a working airflow from entering the motor unit. The rotating shaft also includes a vacuum bore, such that the negative pressure generated by the operation of the fan unit draws any liquid out of an evacuation zone maintained between the motor unit and the end plate. As such, the components of the motor unit are protected from being exposed to the liquid, thereby extending the operating life motor-fan unit.

7 Claims, 4 Drawing Sheets

LABYRINTH SEAL FOR A MOTOR-FAN UNIT

TECHNICAL FIELD

The present invention is generally directed to a seal for use with a rotating shaft of a motor-fan unit. Particularly, the present invention relates to a labyrinth seal for a rotating shaft of a motor-fan unit which prevents liquid from penetrating therethrough. More particularly, the present invention relates to a vacuum bore maintained by the rotating shaft of the motor-fan unit that is configured to evacuate moisture that accumulates in an evacuation zone.

BACKGROUND ART

Electric motors are well known in the art and have been placed into use in a variety of applications, including the handling of air. In this circumstance, an electric motor is coupled to a fan by a rotating shaft, creating a motor-fan unit, which produces a flow of air as needed. For example, the motor-fan unit may be used to generate working air for vacuum-type devices, such as vacuum cleaners, utility vacuums, as well as other devices that operate in environments that are dry, or that have varying degrees of moisture. One particular type of motor-fan unit is referred to as a bypass discharge-type motor-fan unit and operates such that working air is moved by the fan unit to create a vacuum that draws debris and liquid entrained air into the fan unit, while a separate cooling fan pulls cooling air into the motor unit to keep it cooled. Due to this operation, bypass discharge-type motor-fan units are configured such that the motor unit receiving the cooling air is separated from the fan unit generating the working air by a plate or other partition. This plate or partition provides an aperture or other interface to allow the shaft maintained by the motor unit to extend therethrough so as to rotate the fan. Unfortunately, during operation of the motor-fan unit, the liquid entrained in the working air tends to penetrate the area of the partition through which the shaft extends. As a result, water, detergents, and other liquid is permitted to come in contact with one or more bearings that carry the rotating shaft of the motor unit, causing it to become degreased, which may contribute to the premature failure of the motor unit. In addition, liquid and debris that penetrates into the region of the motor unit may cause the electrical components of the system to be damaged, causing the motor unit to fail.

In response to this problem, techniques have been developed, which utilize various arrangements of seals to prevent liquid and other debris from entering the motor unit around the portion of the shaft that extends through the partition. However, such techniques are inefficient, and do not provide a commercially acceptable level of performance. For example, air seals have been used in the past to provide a seal about the portion of the shaft of the motor unit that extends into the fan unit. These air seals generate a vacuum to evacuate liquid that has penetrated into the vicinity of the air seal. Unfortunately, such air seals generate an insufficient amount of vacuum pressure, and thus are generally ineffective in thoroughly evacuating liquid and moisture from about the shaft carrying bearing and the electrical components maintained by the motor.

Therefore, there is a need in the art for a bypass discharge-type motor-fan unit that utilizes a labyrinth seal that is disposed about a rotating shaft of the motor unit to prevent liquid from penetrating through the fan unit and into the motor unit. In addition, there is a need for a bypass discharge-type motor-fan unit that maintains a rotating shaft that includes a vacuum bore to evacuate liquid that enters an evacuation zone. Furthermore, there is a need for a bypass discharge-type motor-fan unit that rotates a fan via a shaft to generate a negative-pressure region proximate a vacuum bore maintained by the shaft so that liquid that has entered an evacuation zone can be evacuated by the vacuum generated within the vacuum bore.

SUMMARY OF THE INVENTION

In light of the foregoing, it is a first aspect of the present invention to provide a labyrinth seal for a motor-fan unit.

Another aspect of the present invention to provide a motor-fan unit comprising an end plate having an aperture therethrough, a motor unit attached to the end plate and defining an evacuation zone therebetween, the motor unit having a rotating shaft which has a shaft end that is received through the aperture, the shaft maintaining a vacuum bore extending from an outlet port disposed proximate the shaft end to a vacuum port disposed upon an outer surface of the shaft located proximate the evacuation zone, wherein liquid collected within the evacuation zone is discharged through the vacuum bore, a fan unit attached to the shaft end, the fan generating a negative pressure about the outlet port when moved, and a labyrinth seal disposed within the aperture, the labyrinth seal maintaining a seal about the shaft, so as to prevent the intrusion of liquid through the end plate.

Still another aspect of the present invention is to provide a motor-fan unit comprising an end plate having an aperture disposed therethrough, a motor unit attached to the end plate, the motor unit having a rotating shaft which has a shaft end that is received by the aperture, a labyrinth seal disposed within the aperture, the labyrinth seal maintaining a seal about the shaft so as to prevent the intrusion of liquid through the end plate, and a fan attached to the end of the shaft.

Yet another aspect of the present invention is to provide a motor-fan unit comprising an end plate having an aperture therethrough, a motor unit attached to the end plate and defining an evacuation zone therebetween, the motor unit having a rotating shaft which has a shaft end that is received through the aperture, the shaft maintaining a vacuum bore extending from an outlet port disposed proximate the shaft end to a vacuum port disposed upon an outer surface of the shaft located proximate the evacuation zone, wherein liquid collected within the evacuation zone is discharged through the vacuum bore, and a fan unit attached to the shaft end, the fan generating a negative pressure about the shaft end when moved.

Still another aspect of the present invention is to provide a method for forming a labyrinth seal for a motor-fan unit comprising providing a motor unit having a rotating shaft that extends through an end plate attached to the motor unit, the shaft moving a fan attached thereto, attaching a engagement seal to the end plate, placing a spacer upon the fabric seal, such that an outer wall extending from an inner surface of the spacer is adjacent the fabric seal, applying pressure to the spacer, and rotating the spacer so as to form a groove in the fabric seal, so as to form a labyrinth seal about the shaft.

BRIEF DESCRIPTION OF THE DRAWINGS

For a complete understanding of the objects, techniques and structure of the invention, reference should be made to the following detailed description, appended claims, and accompanying drawings, wherein:

BEST MODE FOR CARRYING OUT THE INVENTION

Figure 1:
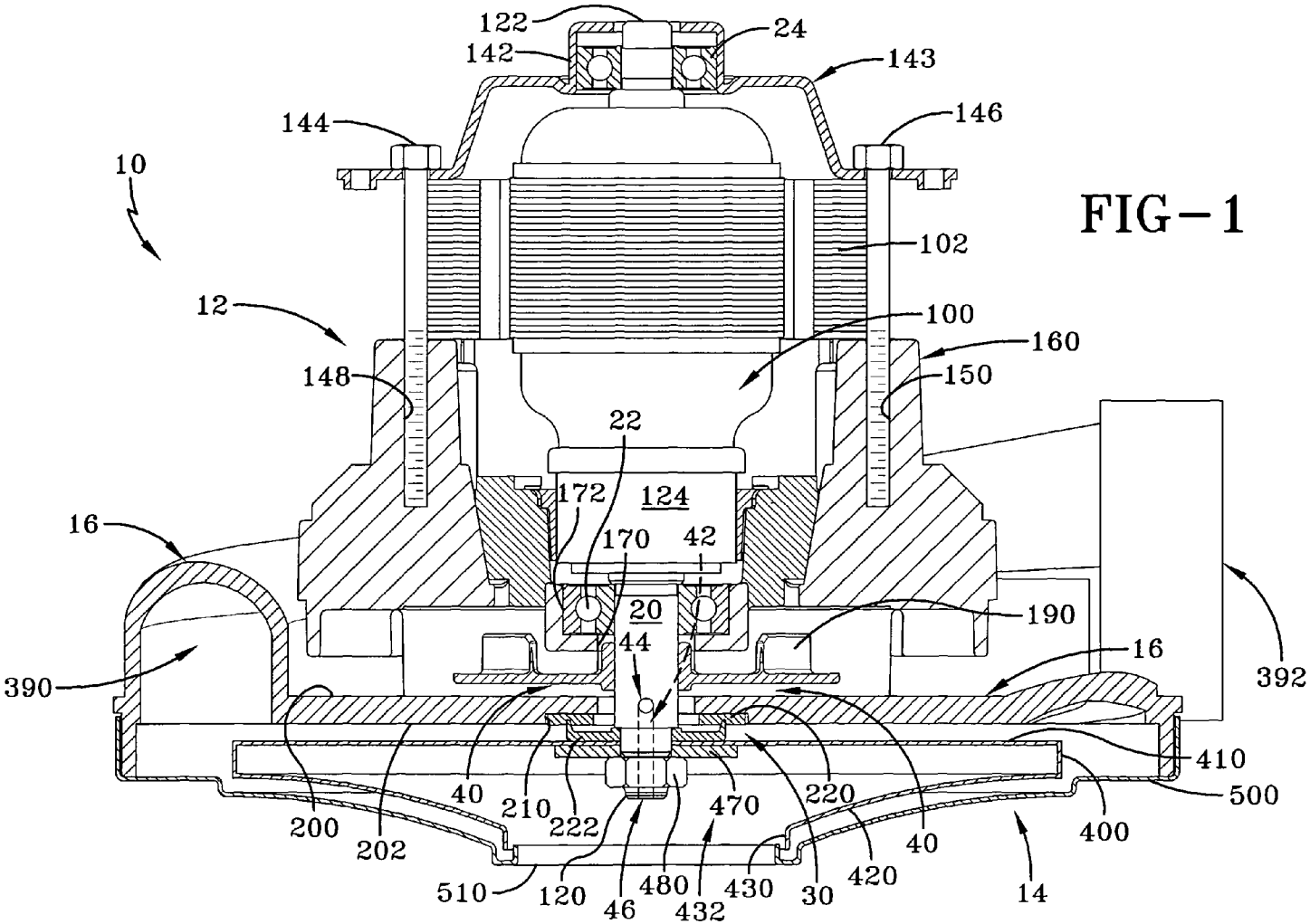
FIG. 1 is a cross-sectional view of a bypass discharge-type motor-fan unit utilizing a labyrinth seal and vacuum bore in accordance with the concepts of the present invention.

A bypass discharge-type electric motor-fan unit in accordance with the concepts of the present invention is generally referred to by the numeral 10, as shown in FIG. 1 of the drawings. The motor-fan unit 10 includes a motor unit 12 and a fan unit 14 that are separated by an end plate 16. The motor unit 12 maintains a shaft 20 that is rotatably supported at each end by bearings 22,24, and which passes through a labyrinth seal 30 maintained by the end plate 16.

The labyrinth seal 30 serves to impede the penetration of liquid or moisture into an evacuation zone 40 that is defined as the region between the motor unit 12 and the endplate 16. For the purposes of the following discussion, it should be appreciated that the term "liquid" also includes any liquefied material, including moisture, liquefied debris, and liquids that carry solid debris. In addition, the shaft 20 maintains a vacuum bore 42 that fluidly connects a vacuum port 44 disposed on the outer surface of the shaft 20 with an outlet port 46 disposed at the end of the shaft 20 that is proximate the fan unit 14. Any liquid that penetrates through the labyrinth seal 30, or otherwise enters the evacuation zone 40 is evacuated therefrom by the negative pressure, or vacuum, generated within the vacuum bore 42 by the operation of the fan unit 14. As such, the labyrinth seal 30 and the vacuum bore 42 prevent any liquid or debris from accumulating in and about the region of the bearing 22 that is proximate the fan unit 14. Such operation prevents the bearing 22 from being degreased, thereby extending the operating life of the motor-fan unit 10, while liquid is prevented from corroding or otherwise harming the components of the motor unit 12. Furthermore, while the operation of the labyrinth seal 30 and the vacuum bore 42 complement each other when used together, it is contemplated that either of the labyrinth seal 30 or vacuum bore 42 may be used independently in connection with the motor-fan unit 10. With the general aspects of the present invention set forth, the discussion that follows will present components of the motor-fan unit 10 and that of the labyrinth seal 30 and the vacuum bore 42.

Figure 2:
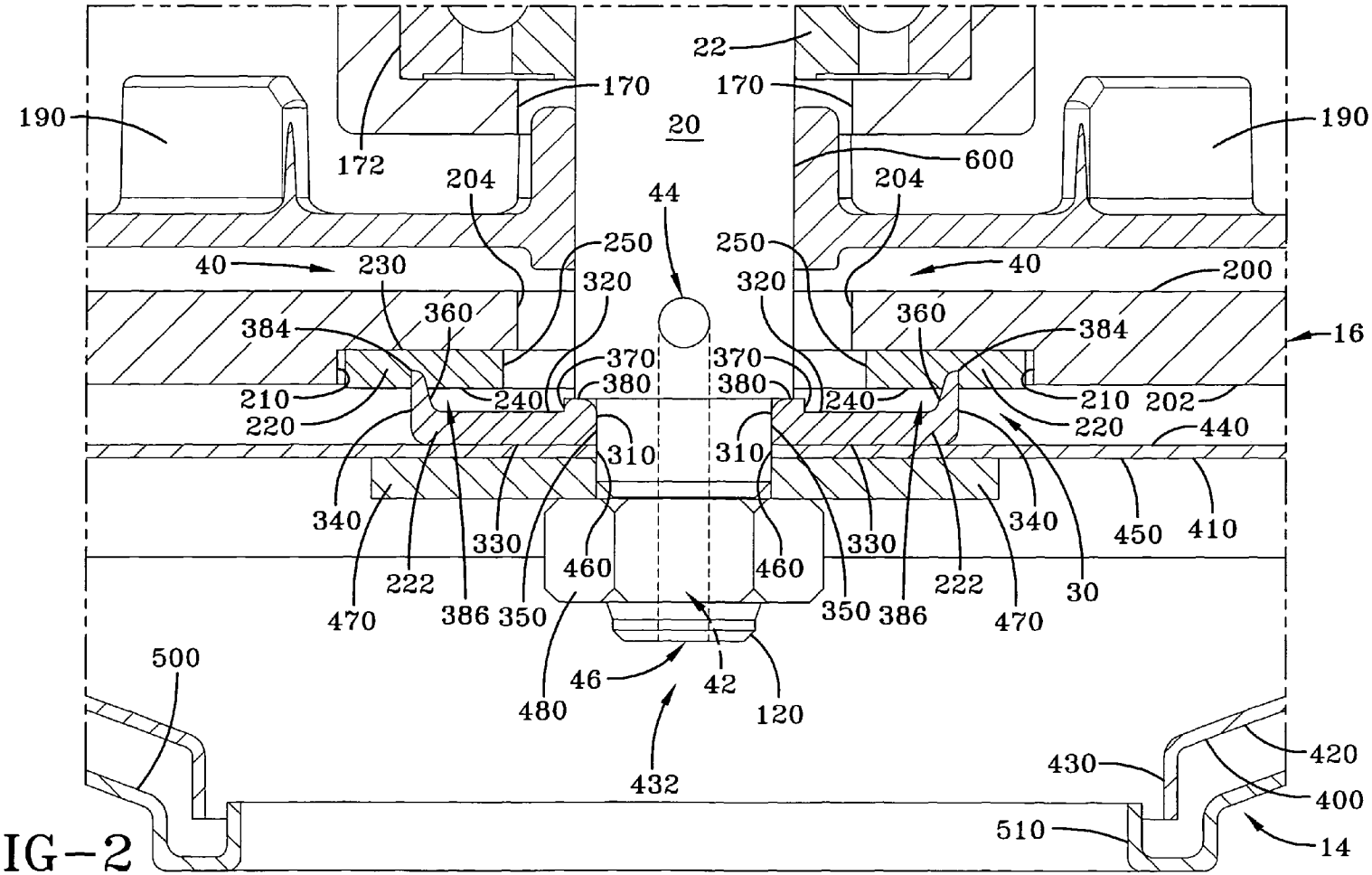
FIG. 2 is a further cross-sectional view of the motor-fan unit showing the components of the labyrinth seal and vacuum bore in accordance with the concepts of the present invention.
Figure 2A:
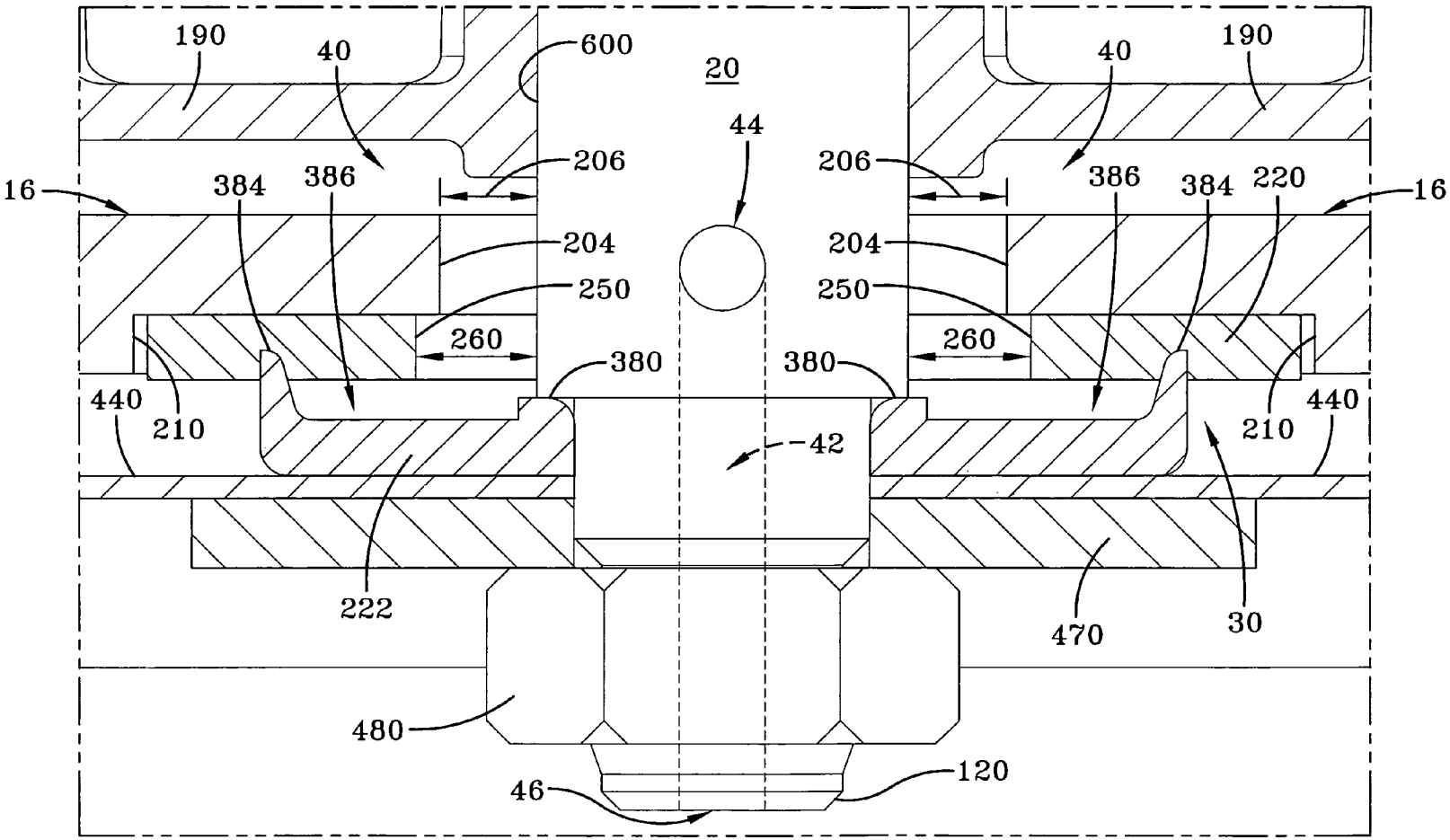
FIG. 2A is a cross-sectional view of the motor-fan unit showing the components of the labyrinth seal and vacuum bore in further detail in accordance with the concepts of the present invention.

Continuing with reference to FIGS. 1-2A, the motor unit 12 includes an armature 100 that is rotatably disposed within a fixed lamination stack 102. Although not shown in detail, skilled artisans will appreciate that respective windings are separately wrapped around the armature and the lamination stack. The armature 100 is carried by the shaft 20 that is rotatably supported at each end 120 and 122 by respective support bearings 22 and 24. The armature 100 carries a commutator 124 that is configured to receive electrical current from a pair of brushes which are not shown in detail. The bearing 24 is retained in a bearing retainer 142 that is maintained by a support bracket 143 that is attached proximate end 122 of the shaft 20 by a pair of suitable threaded fasteners. For example, threaded fasteners 144 and 146 connect the support bracket 143 to a motor bracket 160. Indeed, bracket 160 provides corresponding threaded bores 148 and 150 to receive fasteners 144 and 146. It should be appreciated that the support bracket 143 and the motor bracket 160 may be formed from any suitable material, including but not limited to steel, aluminum, and/or plastic. In addition, the motor bracket 160 maintains an aperture 170 through which the shaft 20 is received. Disposed about the aperture 170 is a bearing mount 172 which retains bearing 22 therein. As such, the motor bracket 160 provides a point of attachment for the motor unit 12 via the mounting bores 148,150. The bracket 160 also serves as an interface for attaching the motor unit 12 to the end plate 16, by using a frictional fit or any suitable fastener, such as screws, rivets, adhesive, and the like. However, it should be appreciated that in lieu of the motor bracket 160, the motor unit 12 may be directly attached to the end plate 16 using known techniques.

During operation of the motor unit 12, electrical current is supplied to the commutator 124 via the brushes, causing the armature 100 to rotate so as to apply a driving force to a fan within the fan assembly 14. In addition to rotating the fan, which will be discussed in detail below, the shaft 20 may also rotate a cooling fan 190, which is mounted at a point on the shaft 20 that is between the motor bracket 160 and the end plate 16. The cooling fan 190 serves to generate a cooling airflow for the commutator 124, brushes, as well as the other components of the motor unit 12 to prevent overheating and thermal wear.

The end plate 16 comprises an inner surface 200 that is disposed proximate the motor unit 12, and an opposing outer surface 202, disposed proximate the fan unit 14. Disposed through the endplate 16 is an aperture 204, which is substantially coaxial with the aperture 170 of the motor bracket 160, and which is oriented to receive the shaft 20 therethrough. It should be appreciated that the aperture 204 is dimensioned so that there is a gap 206, best seen in FIG. 2A, maintained between the shaft 20 and the perimeter of the aperture 204. In addition, disposed upon the outer surface 202 is a substantially square counterbore 210, although the counterbore 210 may be dimensioned to take on any desired shape. Disposed between the end plate 16 and the fan unit 14 is the labyrinth seal 30, which includes an engagement seal 220 and a spacer 222.

Figure 3A:
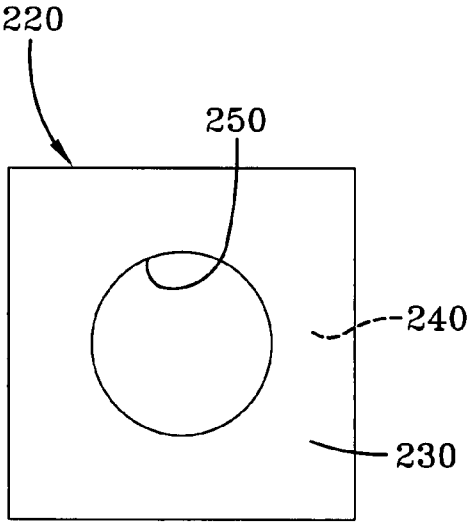
FIG. 3A is a plan view of am engagement seal forming part of the labyrinth seal in accordance with the concepts of the present invention.
Figure 3B:
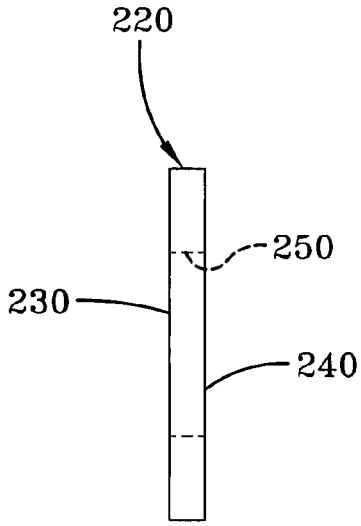
FIG. 3B is a side elevational view of the engagement seal shown in FIG. 3A in accordance with the concepts of the present invention.

The engagement seal 220, as shown in FIGS. 3A-B is substantially square-shaped, although any other suitable shape may be utilized that substantially matches the shape of the counterbore 210, and is formed from polytetrafluoroethylene (PTFE) material, such as TEFLON®. In particular, the engagement seal 220 maintains an attachment surface 230 that is opposite a receiving surface 240, wherein the attachment surface 230 maintains a suitable adhesive for retaining the engagement seal 220 within the counterbore 210 of the end plate 16. In addition, the engagement seal 220 maintains an aperture 250 through which the shaft 20 is received. However, it should be appreciated that the aperture 250 is dimensioned so that gap 260, best seen in FIG. 2A, is maintained between the shaft 20 and the perimeter of the aperture 250.

Figure 4A:
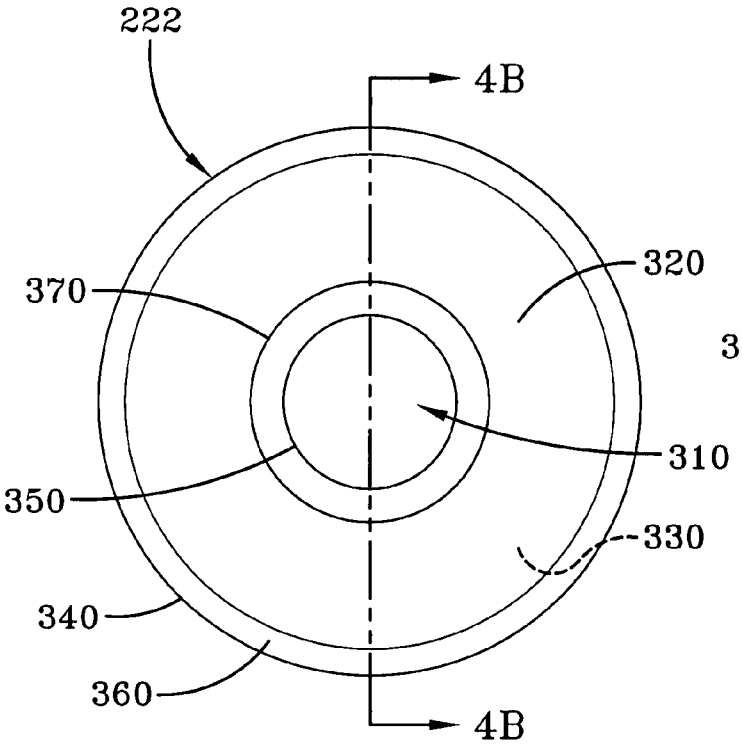
FIG. 4A is a plan view of a spacer forming part of the labyrinth seal in accordance with the concepts of the present invention.
Figure 4B:
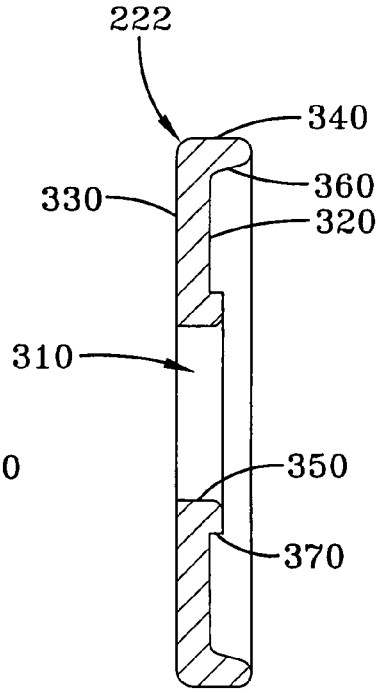
FIG. 4B is a cross-sectional view of the spacer taken along lines 4B-4B in FIG. 4A in accordance with the concepts of the present invention.

To complete the labyrinth seal 30, the spacer 222, as shown in FIGS. 4A-B, is utilized. The spacer 222, which includes an aperture 310, is formed of powdered metal, although other suitable materials may be used including: aluminum, steel, and/or plastic. In addition to maintaining an aperture 310 therethrough, the spacer 222 is substantially cylindrical in shape and maintains an inner surface 320 that is opposite an outer surface 330. In addition, the outer dimension of the spacer 222 is defined by an outer edge 340, while the aperture 310 is defined by an inner edge 350. Extending at a substantially right angle from inner surface 320 of the spacer 222 about the outer edge 340 is an outer wall 360, while an inner wall 370 extends at a substantially right angle from the inner surface 320 of the spacer 222. In particular, the inner wall 370 is dimensioned to engage a ledge or step surface 380 maintained by the shaft 20 so as to be rotatably carried thereby, while the outer wall 360 of the spacer 222 is dimensioned to penetrate into, or otherwise engage the receiving surface 240 of the engagement seal 220. Alternatively, the spacer 222 may be configured such that it does not engage the ledge 380, but is affixed to the shaft 20 in any suitable manner so as to be rotatably carried thereby.

In one aspect, to ensure that the outer wall 360 of the spacer 222 thoroughly engages the engagement seal 220, a "cutting" process is implemented, whereby sufficient force is applied to the spacer 222 so that the outer wall 360 fully engages the receiving surface 240 of the engagement seal 220. Once engaged, the shaft 20 is rotated causing the spacer 222 to rotate thereby creating a groove 384 to be "cut" or otherwise formed in the engagement seal 220, as shown in FIG. 2A. To facilitate the "cutting" process, and reduce the possibility of tearing the engagement seal 220, the spacer 222 may be impregnated or otherwise treated with oil or other suitable lubricant. In one aspect, the use of powdered metal to form the spacer 222 facilitates its ability to retain lubricants, such as oil, and thus is beneficial for use in the operation of the labyrinth seal 30. It should be appreciated that the dimension of the outer and inner walls 360,370 are selected so that a gap 386 is maintained between the engagement seal 220 and the spacer 222 when they are engaged with each other.

To facilitate the movement of working air, the end plate 16 also maintains an intake port 390, which directs or otherwise routes working air generated by the fan unit 14 to a discharge port 392 where the air is exhausted from the motor-fan unit 10. Furthermore, it should be appreciated that the end plate 16 may be formed of plastic, steel, aluminum or any other suitable material.

The fan unit 14 comprises a fan 400 having a base end 410 that is opposite a tapered end 420 through which a fan intake 430 is disposed therethrough. The base end 410 and the tapered end 420 are separated by vanes which form a plurality of voids 432 or open regions. Further, the base end 410 maintains an inner surface 440 that is opposite an outer surface 450 through which is disposed an aperture 460 that is dimensioned to receive the shaft 20. The shaft 20 extends through the aperture 460 such that the end 120 of the shaft 20 is disposed within the void 432. The fan 400 is attached to the shaft 20 via a washer 470 and a suitable fastener, such as a nut 480 that is threadably attached the end 120 of the shaft 20. In addition to retaining the fan 400 to the shaft 20, the nut 480 also serves to ensure that the inner surface 440 of the fan 400 applies a suitable amount of force to the spacer 222 so that it is both carried by the shaft 20 and is urged against the engagement seal 220 during the operation of the motor-fan unit 10.

Covering the outside of the fan 400 is a shroud 500 that is attached to the end plate 16 using any suitable means, such as a friction fit for example. The shroud 500 includes an intake port 510 that is substantially aligned with the fan intake 430 that opens into the void 432. The intake port 510 allows the fan 400 to generate a working airflow that forms a region of negative pressure or a vacuum about the end 120 of the shaft 20 that extends within the void 432. Thus, as the fan 400 is rotated by the shaft 20, the outer wall 360 of the spacer 222 rotates within the groove 384 maintained by the engagement seal 220, thus enabling the labyrinth seal 30 to resist the intrusion of any liquid entrained in the working airflow from entering the motor unit 12.

However, in the event that liquid is able to penetrate through the labyrinth seal 30, it is permitted to collect in and about the evacuation zone 40. Once collected in the evacuation zone 40, the liquid is evacuated therefrom by operation of the vacuum bore 42 that is substantially coaxial with the shaft 20. Specifically, the vacuum bore 42 is fluidly coupled at each end by the vacuum port 44 and an outlet port 46. In particular, the vacuum port 44 is disposed upon an outer surface 600 of the shaft 20 at a point that is within the aperture 204 maintained by the end plate 16. However, it should be appreciated that the vacuum port 44 may be located at any point on the outer surface 600 of the shaft 20 that is between the cooling fan 190 and the aperture 250 maintained by the engagement seal 220. Furthermore, the vacuum port 44 may extend from the vacuum bore 42 to the outer surface of the shaft 20 at a substantially right angle, although any suitable angle may be utilized. In one aspect, the vacuum port 42 maybe comprised of one or more apertures disposed about the outer surface 600 of the shaft 120. The outlet port 46 is disposed at the end 120 of the shaft 20 that is maintained within the void 432 of the fan 400. It should be appreciated that the outlet port 46 may be comprised of one or more apertures disposed about the end 120 of the shaft 20. Alternatively, the output port 46 may be disposed about the outer surface 600 of the shaft 20 proximate the end 120. Thus, as the motor unit 12 rotates the fan 400 by the shaft 20, a negative pressure is generated in the region about the outlet port 46. This negative pressure region serves to create a vacuum within the vacuum bore 42, thereby resulting in any liquid that has accumulated within the evacuation zone 40 being drawn into the vacuum bore 42 via the vacuum port 44. Once within the vacuum bore 42, the liquid is discharged into the void 432 via the outlet port 46, where it combines with the working airflow generated by the fan 400.

Thus, liquid that penetrates through the labyrinth seal 30, during operation of the motor-fan unit 10 is collected within the evacuation zone 40. As the shaft 20 rotates the fan 400, negative pressure, or a vacuum, is generated in the region of the outlet port 46. This negative air pressure causes the liquid anywhere within the evacuation zone 40 to be drawn from the vacuum port 44 and through the vacuum bore 42, where it is discharged back into the void 432 via the outlet port 46. Therefore, because liquid is contained and evacuated from the evacuation zone 40, it does not accumulate, and, as such, it is prevented from coming into contact with the bearing 22. This prevents the bearing 22 from becoming degreased and prevents the corrosion of any of the other components of the motor unit 12, thereby extending the operating life of the motor unit 12. It should be appreciated that the operation of the cooling fan 190 also serves as an additional barrier to liquid that may enter the evacuation zone 40. That is, liquid entering the evacuation zone 40 tends to be deflected away from the bearing 22 and other components of the motor unit 12 by the movement of the cooling fan 190.

It will therefore be appreciated that one advantage of one or more embodiments of the present invention is that a bypass discharge-type motor-fan unit utilizes a labyrinth seal to prevent the intrusion of liquid entrained in a working airflow from entering the motor unit. Another advantage of the present invention is that the shaft of the motor-fan unit includes a vacuum bore that maintains a negative pressure therein, such that liquid collected in an evacuation zone is evacuated therefrom to prevent the premature wear of the components of the motor unit.

Thus, it can be seen that the objects of the invention have been satisfied by the structure and presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A motor-fan unit comprising:

an end plate having an aperture therethrough;

a motor unit attached to said end plate and defining an evacuation zone therebetween, said motor unit having a rotating shaft which has a shaft end that is received through said aperture, said shaft maintaining a vacuum bore extending from an outlet port disposed proximate said shaft end to a vacuum port disposed upon an outer surface of said shaft located proximate said evacuation zone, wherein liquid collected within said evacuation zone is discharged through said vacuum bore;

a fan unit attached to said shaft end, said fan generating a negative pressure about said outlet port when moved; and a labyrinth seal disposed within said aperture, said labyrinth seal maintaining a seal about said shaft, so as to prevent the intrusion of liquid through said end plate, wherein said labyrinth seal comprises an engagement seal receiving said shaft and attached to said end plate, and a spacer received and carried by said shaft, wherein said spacer has a spacer inner surface from which extends an outer wall at an angle such that rotation of said spacer by said shaft causes said outer wall to form a groove in said engagement seal to complete said labyrinth seal, wherein said spacer inner surface and said engagement seal form a gap therebetween, and wherein said gap is contiguous with said evacuation zone.

2. The motor-fan unit of claim 1, wherein said engagement seal comprises polytetrafluoroethylene (PTFE).

3. The motor-fan unit of claim 1, wherein said spacer is formed from powdered metal.

4. The motor-fan unit of claim 1, wherein said spacer comprises an inner wall extending from said spacer inner surface configured to engage a ledge surface maintained by said shaft.

5. A method for forming a labyrinth seal for a motor-fan unit comprising:

providing a motor unit having a rotating shaft that extends through an end plate attached to said motor unit, said motor unit and said end plate defining an evacuation zone therebetween, said shaft having a shaft end extending past said end plate, said shaft end having an outlet port and said shaft having an outer surface with a vacuum port located proximate said evacuation zone, said shaft moving a fan attached thereto and said shaft maintaining a vacuum bore extending from said outlet port to said vacuum port;

attaching an engagement seal to said end plate;

receiving a spacer on said shaft such that said spacer is rotatable with said shaft;

placing said spacer upon said engagement seal, such that an outer wall extending from an inner surface of said spacer is adjacent said engagement seal;

applying pressure to said spacer; and rotating said spacer so as to form a groove in said engagement seal, so as to form a labyrinth seal about said shaft wherein said inner surface of said spacer and said engagement seal form a gap therebetween such that said gap is contiguous with said evacuation zone.

6. The method of claim 5, wherein said engagement seal is formed from polytetrafluoroethylene (PTFE).

7. The method of claim 5, wherein said spacer is formed from powdered metal.

* * * * *